US005339227A

United States Patent [19]

Jones

[11] Patent Number: 5,339,227

[45] Date of Patent: Aug. 16, 1994

[54] ILLUMINATOR FOR ARCHERY AIMING SCOPE

[76] Inventor: Kenneth C. Jones, 7212 Ludwood Ct., Alexandria, Va. 22306

[21] Appl. No.: 101,835

[22] Filed: Aug. 4, 1993

[51] Int. Cl.[5] ..... F21V 33/00; F41G 1/00

[52] U.S. Cl. ..... 362/109; 33/241; 33/265; 124/87

[58] Field of Search ..... 362/109, 110; 33/265, 33/241, 245; 124/87

[56] References Cited

U.S. PATENT DOCUMENTS

| | | | |
|---|---|---|---|
| 4,179,613 | 12/1979 | Koren | 250/215 |
| 4,220,983 | 9/1980 | Schroeder | 362/114 |
| 4,521,972 | 6/1985 | Larson | 33/265 |
| 4,567,668 | 2/1986 | Kihg et al. | 33/265 |
| 4,627,171 | 12/1986 | Dudney | 33/241 |
| 4,638,565 | 1/1987 | Podany et al. | 33/265 |
| 4,977,677 | 12/1990 | Troescher, Jr. | 33/265 |
| 5,065,520 | 11/1991 | Shimizu et al. | 33/241 |
| 5,152,068 | 10/1992 | Meister et al. | 33/265 |
| 5,208,989 | 5/1993 | Sanders | 33/241 |

*Primary Examiner*—Ira S. Lazarus
*Assistant Examiner*—Sara Sachie Raab

[57] ABSTRACT

An illuminating device for archery aiming scopes uses a focused, concentrated light beam to illuminate both the aiming mark and level of the scope. The preferred light source is a high brightness, focused light emitting diode which is mounted so as to project a narrow beam of light down onto the aiming mark from a position above and outside the field of view of the scope. Illumination of the level is achieved by means of multiple reflections of the light beam between the lens and the level, with the result that the bubble of the level brightens when the bow is in the desired vertical orientation. The light source is powered by a battery pack which includes an on-off switch and brightness adjusting variable resistance.

3 Claims, 3 Drawing Sheets

ILLUMINATOR FOR ARCHERY AIMING SCOPE

BACKGROUND

1. Field of Invention

This invention relates to archery telescopic aiming sights, specifically to an improved method for illuminating such sights for use under poor lighting conditions.

2. Description of Prior Art

A telescopic aiming sight, referred to as a scope, is commonly used in archery to provide a means for more precise aiming by magnifying the target. The optical component of the scope consists of a single lens mounted within a cylindrical barrel. The purpose of the barrel is to serve as a support for the lens and to minimize reflections. The scope is mounted on a sight mechanism which is attached to the bow handle. The bow handle is referred to as the riser. The sight mechanism permits the scope to be raised and lowered with respect to the riser. Lowering the scope has the effect of causing the archer to aim higher, thereby increasing the elevation of the trajectory of the arrow. A higher arrow trajectory is required to hit targets which are located at longer distances. When the bow is drawn, the archer views the target through the scope while also looking through a small pin hole device. The pin hole device is called a peep and is mounted between strands of the bow string. When the bow is drawn, the peep in the bow string is located near the archer's eye, while the scope and sight mechanism mounted on the riser are at approximately arms length. In these positions, the peep and the scope form a simple telescope approximately one meter in length. When used in this manner, the scope provides magnification of the target while the combined scope and peep assembly permit the archer to precisely align the bow with the target. The typical scope also includes a level, liquid filled except for the indicating bubble, to aid in maintaining precise vertical positioning of the bow while aiming. If the bow is unknowingly inclined to one side, the arrow will impact to that side of the aiming point on the target.

The lens of the sight has an aiming mark, usually a circular dot, located at the center of the lens. The archer aims by placing the aiming mark on the bullseye of the magnified target while looking through the small hole in the peep. To obtain the greatest aiming precision, the hole in the peep is typically made very small. Holes as small as one millimeter in diameter are common. While this small diameter improves the archer's ability to aim with high precision, it also significantly reduces the amount of light reaching the archer's eye. Accordingly, under the poor lighting conditions which are often encountered in archery, the aiming mark and level become difficult to see. This inability to clearly see the aiming mark and level have an adverse impact on the archer's ability to aim. Specifically, the aiming process is mentally and physically very challenging, requiring total concentration by the archer. Any distractions tend to break the archer's concentration, reducing shooting accuracy. Difficulties in clearly seeing the aiming mark and level represent a significant distraction. To compensate for the loss of light caused by the small diameter of the peep hole, very bright illumination of the aiming mark and at least some illumination of the level are required.

To provide a brighter aiming mark, U.S. Pat. No. 4,220,983 issued to Schroeder (1980) and U.S. Pat. No. 4,638,565 issued to Podany and Glaseman (1987) both use an illumination method which places the light source itself directly at the center of the lens to serve as a lighted aiming dot. U.S. Pat. No. 5,152,068 issued to Meister (1992) uses a light source which shines on the aiming mark. To provide sufficient brightness, the light source is mounted on a support which protrudes into the viewing area in order to place the light source near enough to the aiming mark to achieve a useable brightness. Another technique in use is to illuminate one end of an optical glass fiber. The other end of the fiber is placed at the center of the lens with the fiber pointed at the archer. The light exiting from the fiber appears as a bright spot visible to the archer. All of these designs have either electrical wires, optical fibers, or other structures crossing the scope viewing area. These structures are objectionable in that they partially obstruct the archer's view of the target through the scope and distract the archer during the aiming process. A further disadvantage is that these structures are near the lens, making cleaning of the lens difficult. In addition, fine wiring and optical fibers on or near the lens surface are easily damaged when attempting to clean the lens.

U.S. Pat. No. 4,977,677 issued to Troescher (1990) disclosed a telescopic archery sight in which one or more light sources are used to introduce light into the edge of the lens. A portion of the light travels internally through the clear lens material and illuminates reticle markings on the lens surface. This approach avoids the problem of extraneous obstructions partially obscuring the scope viewing area. However, only a small amount of the light which is introduced into the edge of the lens actually reaches the aiming mark. The resulting aiming mark brightness is marginal when used with the typical peep having a small hole.

SUMMARY OF THE INVENTION

My illuminating device addresses each of the shortcomings of previous designs and provides numerous additional benefits. Specifically, several objects and advantages of my illuminating device are:

(a) to provide a brightly illuminated aiming mark;
(b) to provide a viewing area without obstructions;
(c) to provide illumination of the scope level;
(d) to provide an inexpensive means of illumination which can be added to existing standard unilluminated scopes;
(e) to allow the archer to easily modify the shape and size of the aiming mark;
(f) to provide an illumination approach which permits use of the scope as a standard unilluminated scope in the event of light source failure.

Further objects and advantages of my illuminating device will become apparent from consideration of the ensuing description and drawings.

BRIEF DESCRIPTION OF THE DRAWINGS

In the drawings, which are described briefly below, the preferred embodiment of my invention is illustrated. These figures are not intended to limit the scope of the invention or methods for applying the basic principle of the invention.

DESCRIPTION OF PREFERRED EMBODIMENT

Figure 1:
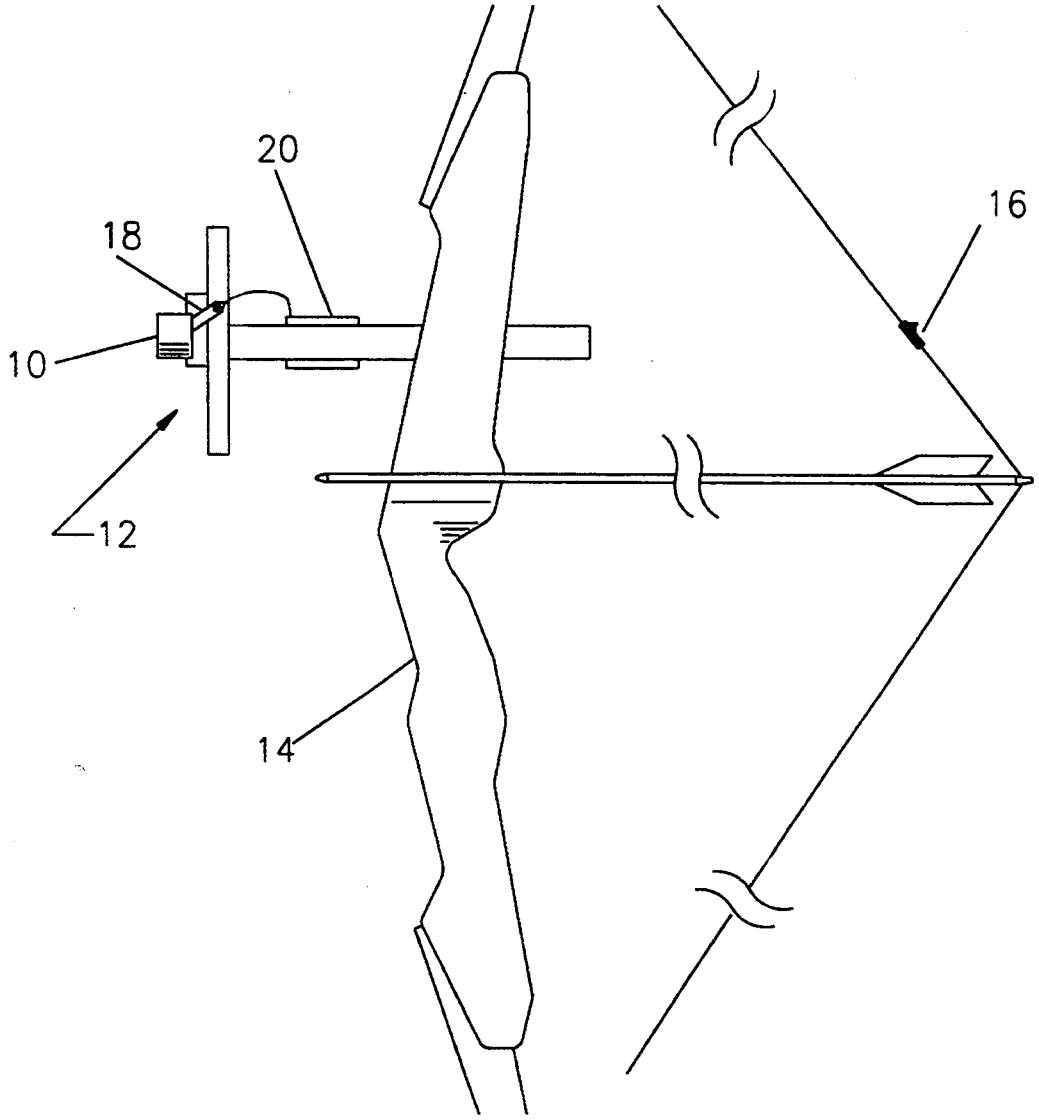
FIG. 1 is an overall view of an archery bow showing the arrangement of riser, peep, sight, and scope with my illuminating device installed.

FIG. 1 depicts a typical scope 10 mounted on a sight mechanism 12 which is in turn mounted to riser 14 of the bow. Pin hole peep 16 is shown mounted between stands of the bow string. Light source and bracket assembly 18 and battery pack assembly 20 of my illuminating device are shown mounted on the scope and sight mechanism, respectively.

Figure 2:
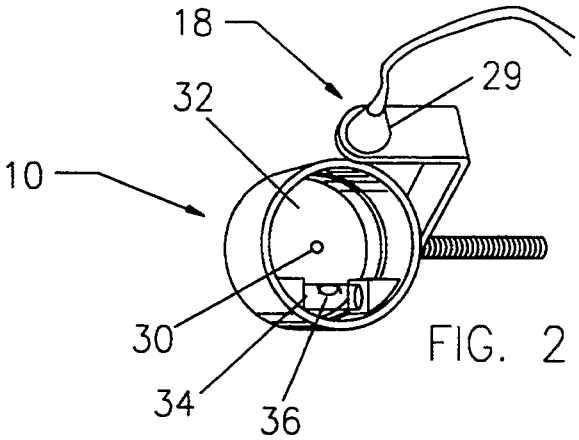
FIG. 2 is a perspective view showing my illuminating device, less battery pack, installed on a typical scope.
Figure 2A:
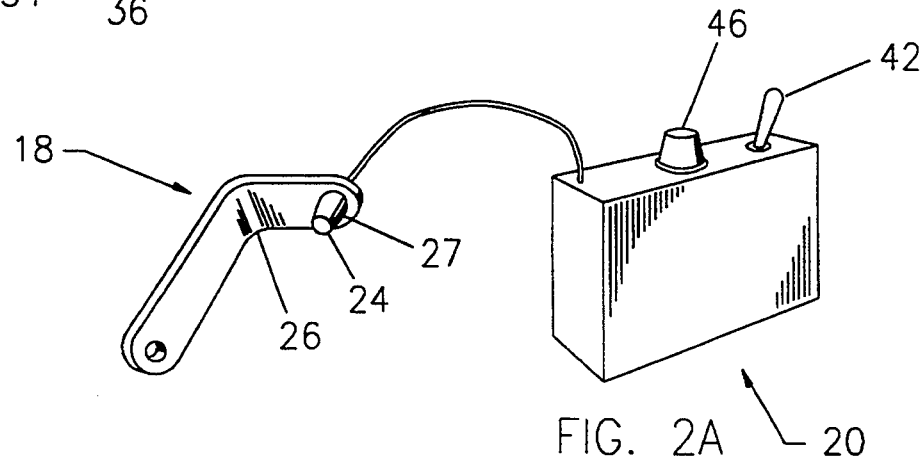
FIG. 2A is a perspective view showing the illuminating device with battery pack when not installed.
Figure 2B:
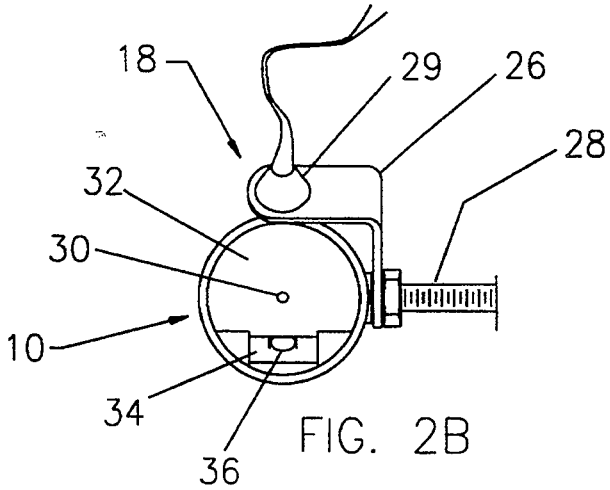
FIG. 2B is a front elevational view of my illuminating device, less battery pack, installed on a typical scope.
Figure 2C:
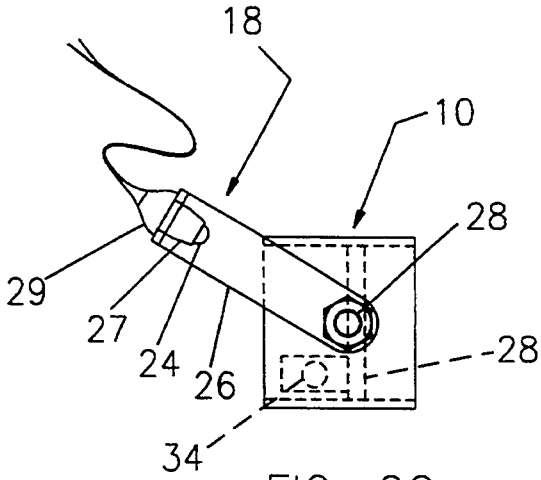
FIG. 2C is a side view showing my illuminating device, less battery pack, installed on a typical scope.

FIG. 2 shows the preferred embodiment of light source and bracket assembly 18 mounted to a typical archery scope 10. FIGS. 2A, 2B, and 2C more clearly depict the construction of my illuminating device. Specifically, as shown in FIG. 2A, the light source and bracket assembly 18 is constructed using a high-brightness light-emitting diode (LED) 24, which has an integral focusing lens, installed in mounting bracket 26. Any conventional high-brightness LED with a luminous intensity of 2000 millicandela (mcd) and with a viewing angle of from 4 to 10 degrees can be used. A convenient and inexpensive method for securing LED 24 to mounting bracket 26 is by using a small piece of heat-shrink tubing 27 on the front and hot-melt glue 29 on the back as shown in FIG. 2C. The hot-melt glue, to which a small amount of graphite powder has been added, forms part of bracket assembly 18 and, in addition to securing LED 24 in position, also produces a non-reflective black surface and provides strain relief for the LED wiring. As shown in FIGS. 2B and 2C, mounting bracket 26 is secured to scope mounting bolt 28. The bracket assembly 18 is positioned such that neither LED 24 nor bracket 26 intrude into the scope viewing area. With LED 24 positioned as shown, the narrow beam of light emitted by LED 24 is projected onto aiming mark 30 in the center of lens 32.

Figure 3:
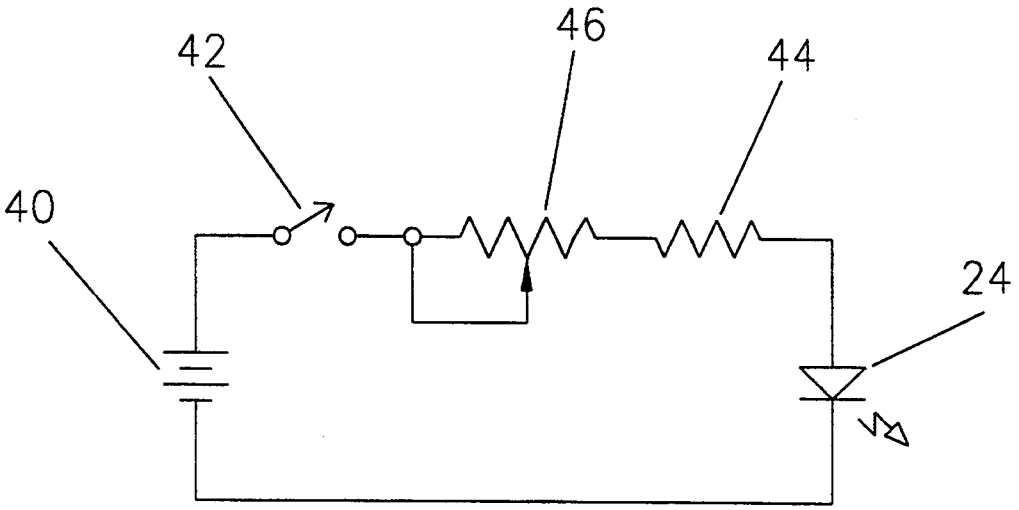
FIG. 3 is an electrical schematic of the illuminating device including the battery pack.

FIG. 3 is the electrical schematic showing the interconnection of LED 24 and the internal components of the battery pack assembly. The battery pack includes battery 40, on-off switch 42, brightness adjusting potentiometer 46, and current-limiting resistor 44. The current-limiting resistor 44 ensures that LED 24 cannot be damaged by excessive current when potentiometer 46 is adjusted for maximum brightness of the LED.

Figure 4A:
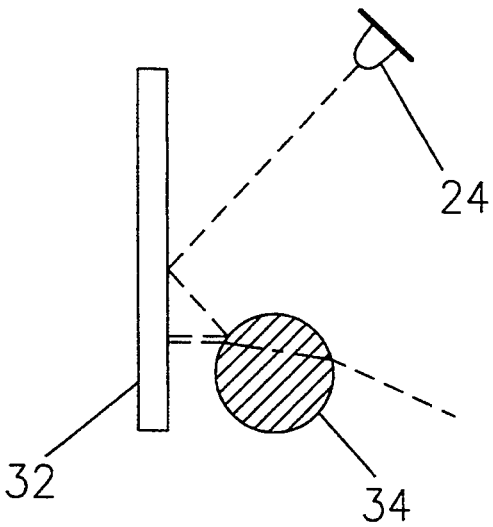
FIG. 4A depicts the light beam path when the bow is not in the correct vertical orientation.
Figure 4B:
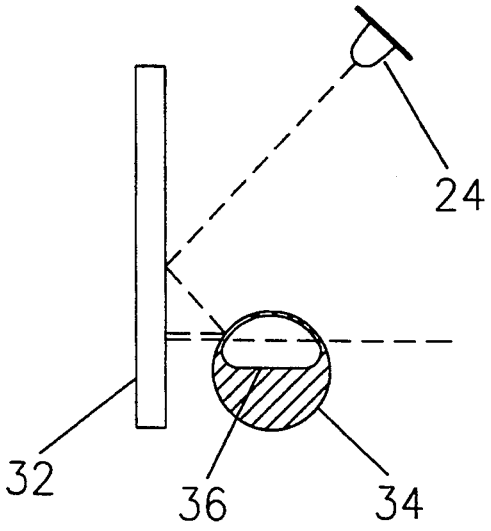
FIG. 4B depicts the light beam path when the bow is in the correct vertical orientation.

In operation, my illuminating device has several distinct and significant advantages for the archer over the approaches used by the prior art devices. Specifically, by projecting a concentrated, narrow light beam onto aiming mark 30 from a location out of the viewing area of the scope, an aiming mark illuminated brightly enough for use with a peep having a small hole is achieved while also providing an unobstructed viewing area. None of the prior art devices have simultaneously provided both of these benefits. Another benefit provided by my illuminating device is that the level as seen by the archer brightens when the bow is held in the correct vertical alignment. While this phenomena appears to be the result of several effects, I believe the brightening is primarily the result of the process discussed below; however, I do not wish to be bound by this. Specifically, as shown in FIGS. 4A and 4B, after leaving LED 24, the light reflects down from lens 32, next hitting the back side of level 34. This light then reflects horizontally, again hitting lens 32 behind level 34, then reflecting back toward the level. When the bow in not in the correct vertical orientation, the bubble is not in the center of the level. The path of the light beam for this case is shown in FIG. 4A. When the bubble is not in the center of level 34, the light is refracted in a downward direction by the fluid-filled level and is only faintly visible to the archer. However, as shown in FIG. 4B, when bubble 36 is in the center of level 34, the light beam can pass straight through the level in the direction of the archer's eye without refraction, causing the bubble of the level, as seen by the archer, to brighten significantly. As a result, the archer benefits by being able to confirm proper bow vertical orientation without diverting attention from the concentration-intensive aiming process. An additional significant benefit provided by projecting a light beam onto the aiming mark is that the aiming mark can be easily adjusted to the archer's preferred size and shape by simply painting or otherwise constructing the desired mark on the surface of the lens. A still further benefit is that, in the preferred embodiment, my illuminating device can be added to the archer's present unlighted scope. This, in effect, inexpensively converts the archer's scope of choice into a highly effective lighted scope which does not possess the disadvantages of the prior art. Yet another advantage provided by my illuminating device is that, in the unlikely event that the light source should fail, the scope reverts to its still quite useable unlighted form. Most of the prior art devices are extremely difficult to use when the light source is not functioning. There is yet another benefit provided by illuminating the aiming mark with a narrow light beam, rather than by the more obvious approach of illuminating the scope with a less confined general illumination of the entire lens. Specifically, general illumination causes all dust or water droplets, which accumulate on the lens during use in the field, to become more visible and distracting. This problem is minimized with my illuminating device wherein the narrow beam of light is focused primarily on the aiming dot.

From the description above, the numerous advantages of my invention become evident:

(a) The aiming dot of the scope is brightly illuminated as required for use with the typical peep having a small hole while at the same time not obstructing the viewing area of the scope with distracting wires or fibers near the lens which can be damaged or which impede access when cleaning the lens.

(b) The level of the scope is illuminated such that the bubble, as viewed by the archer, brightens when the bow is in the correct vertical orientation.

(c) The illuminating device can be added inexpensively to a standard unilluminated scope.

(d) The illumination method permits the archer to easily modify the aiming mark to the desired size and shape.

(e) Should the light source fail due to depleted batteries, the scope still functions as a conventional unlighted scope.

Although the descriptions above describe a specific embodiment, this should not be viewed as limiting the scope of the invention but rather to illustrate the basic principle. For example, the basic method could easily be adapted to incorporate the illuminating device as an integral part of a standard scope.

I claim:

1. An illuminating device for attachment to an archery sighting scope comprising a light source, a focusing means for said light source, a support means for said light source and focusing means, and an energy source connected to said light source, the improvement wherein said illuminating device simultaneously brightly illuminates the aiming mark of said sighting scope, illuminates the level of said sighting scope, and provides an unobstructed view through said sighting scope by having said light source, said focusing means, and said support means located so as to illuminate the aiming mark and level from a position outside the viewing area of said sighting scope.

2. The device of claim 1 wherein said light source and said focusing means are comprised of a focused, high-brightness light emitting diode with an integral focusing lens.

3. The device of claim 1 wherein the energy source is a battery.

* * * * *